US005248870A

United States Patent [19]

Redal

[11] Patent Number: 5,248,870

[45] Date of Patent: Sep. 28, 1993

[54] ELECTRIC HEATING DEVICE FOR WARMING THE CONTENTS OF BOTTLES OR OTHER CONTAINERS

[76] Inventor: Marlyn Redal, 2315 Fulton, Everett, Wash. 98201

[21] Appl. No.: 811,703

[22] Filed: Dec. 20, 1991

[51] Int. Cl.[5] ..... H05B 3/00

[52] U.S. Cl. ..... 219/521; 34/202; 211/74; 219/242; 219/385; 219/387; 219/433

[58] Field of Search ..... 219/520, 521, 242, 433, 219/385-387; 34/202; 211/74

[56] References Cited

U.S. PATENT DOCUMENTS

| | | | |
|---|---|---|---|
| 241,142 | 5/1881 | Keech | 211/74 X |
| 746,832 | 12/1903 | Hecker | 211/74 X |
| 1,992,089 | 2/1935 | O'Callaghan | 219/521 X |
| 2,090,666 | 8/1937 | Copeland . | |
| 2,187,196 | 1/1940 | Douglass | 219/387 |
| 2,292,992 | 8/1942 | Crouch . | |
| 2,413,176 | 12/1946 | Deaton . | |
| 2,450,981 | 10/1948 | Newman | 219/385 |
| 2,527,049 | 10/1950 | Aagesen | 219/521 X |
| 2,577,327 | 12/1951 | Hill | 219/521 X |
| 2,644,072 | 6/1953 | Aruth | 219/521 |
| 2,653,214 | 9/1953 | Shaw | 219/521 X |
| 2,713,112 | 7/1955 | Mills et al. . | |
| 2,842,654 | 7/1958 | Anderson | 219/433 |
| 3,005,904 | 10/1961 | Thompson . | |
| 3,138,699 | 6/1964 | Taylor . | |
| 3,152,242 | 10/1964 | Litman . | |
| 3,415,978 | 12/1968 | Hanson | 219/521 X |
| 3,456,579 | 7/1969 | Woods . | |
| 4,107,513 | 8/1978 | Ashford . | |
| 4,119,834 | 10/1978 | Losch . | |
| 4,215,843 | 8/1980 | Gay et al. . | |
| 4,273,992 | 6/1981 | Thomas . | |
| 5,057,671 | 10/1991 | Colson | 219/521 |

FOREIGN PATENT DOCUMENTS

| | | | |
|---|---|---|---|
| 2556892 | 3/1977 | Fed. Rep. of Germany | 219/521 |
| 2746046 | 4/1979 | Fed. Rep. of Germany | 219/521 |
| 934157 | 1/1948 | France | 219/521 |

*Primary Examiner*—Anthony Bartis
*Attorney, Agent, or Firm*—Hughes & Multer

[57] ABSTRACT

A heating device for warming the contents of bottles and other containers. The device has a casing in which a radiant heater is mounted and a container-receiving cylindrical insert in the casing in heat transfer relationship to the radiant heater. The insert is removable from the casing through an opening in the casing top to facilitate cleaning. The insert has an imperforate lower portion capable of intercepting and trapping any product which may drip or run down the container side and openings in an upper portion allowing air to circulate into convective heat transfer with the container. The closed base of the insert has a raised seat which spaces the bottom of the container above the insert base to allow air to circulate across the bottom of the insert and to prevent any product collected in the insert from soiling the container.

9 Claims, 2 Drawing Sheets 34
90
96
102
92
94
88
108
86
100
576
74
32
68
72
50
44
58
52
54
56
70
20
40
62
32
78
66
36
64
108
48
46
60
82
30
42
84
70
44
82
34
66
38
48
36
66
64
40
80
83
42

ELECTRIC HEATING DEVICE FOR WARMING THE CONTENTS OF BOTTLES OR OTHER CONTAINERS

TECHNICAL FIELD OF THE INVENTION

The present invention relates to heating devices and, more particularly to novel, improved devices for heating or warming the contents of bottles and other containers.

The principles of the present invention can be employed to particular advantage in warming shampoos, conditioners, and other hair care products; and the principles of the present invention will accordingly be developed primarily with reference to such applications of the invention. It is to be understood, however, that this is being done for the sake of brevity and clarity and is not intended to limit the scope of the invention as defined in the appended claims.

BACKGROUND OF THE INVENTION

It is well known that the application of unheated, room temperature shampoos, rinses, conditioners, shaving cream, and the like to a person's scalp or face can produce a very uncomfortable and unpleasant feeling. This gives rise to frequent complaints in beauty salons, barbershops, and other establishments where the customer's comfort and consequent satisfaction is of paramount importance.

Unpleasant sensations can be avoided and comfort assured by warming the shampoo or other formulation in its container before applying it to the customer's scalp or face.

Also, there are preparations which tend to congeal, crystallize or precipitate, agglomerate, or become viscous at room temperature. This makes it difficult to pour or otherwise expel the contents of the container. Again, this is a problem which can be readily solved by employing a heater utilizing the principles of the present invention to warm the preparation at the time and point of use.

A number of patents disclose heaters for bottles and similar containers, and some of them even disclose heaters for hair care products. The patents of which I am aware are U.S. Pat No. 2,090,666 issued Aug. 24, 1937 to Copeland for HEATER FOR SCALP SOLUTIONS; U.S. Pat. No. 2,292,992 issued Aug. 11, 1942 to Crouch for HEATING DEVICE; U.S. Pat. No. 2,413,176 issued Dec. 24, 1946 to Deaton for MILK BOTTLE HEATER; U.S. Pat. No. 2,713,112 issued Jul. 12, 1955 to Mills et al. for BOTTLE OR CONTAINER WARMER; U.S. Pat. No. 3,005,904 issued Oct. 24, 1961 to Thompson for COMBINATION SALT DRIER AND NIGHT LIGHT; U.S. Pat. No. 3,138,699 issued Jun. 23 1964 to Taylor for HEATING APPLICANCES; U.S. No. 3,152,245 issued Oct. 6, 1964 to Litman for INFRARED NURSING BOTTLE HEATER; U.S. Pat. No. 3,456,679 issued Jul. 22, 1969 to Woods for PACKAGED FOOD DISPLAY AND HEATING DEVICE; U.S. Pat. No. 4,107,513 issued Aug. 5, 1978 to Ashford for SHAMPOO CONDITIONER WARMER; U.S. Pat. No. 4,119,834 issued Oct. 10, 1978 to Losch for ELECTRIC RADIANT HEAT FOOD WARMER AND ORGANIZER; U.S. Pat. No. 4,215,843 issued Aug. 5, 1980 to Gay et al. for TOY MOLDING APPARATUS AND MATERIAL FOR USE THEREWITH; and U.S. Pat. No. 4,273,992 issued Jun. 16, 1981 to Thomas for ELECTRIC HEATING APPARATUS FOR HEAT-TREATING PHARMACEUTICALS.

Heating devices as disclosed in the foregoing patents tend to have a number of drawbacks and disadvantages. One is that they are unsafe to use, particularly in beauty salon and other operations where the user may have wet hands and therefore be particularly susceptible to injury if subjected to electrical shock. Also, the prior art heating devices tend to be very difficult to clean to the level required by local regulations applicable to beauty salons and comparable establishments. Efficient distribution of heat to the product being warmed and lack of easy access to the heating element are still other disadvantages of these prior art heating devices.

SUMMARY OF THE INVENTION

There have now been invented, and disclosed herein, certain new and novel devices for warming shampoo and for other applications which do not have the foregoing or other disadvantages of kindred heating devices. These devices are, efficient, safe to use, and easy to clean. The heating element is well protected, and it is easy accessible. At the same time, the novel heating devices disclosed herein are simple and correspondingly inexpensive to manufacture.

Generally speaking, the novel heating devices disclosed herein include a housing with a base. A heating element such as a conventional incandescent bulb is mounted on the base, typically in an upright orientation and midway between the ends of the casing.

A removable end wall and circular openings in the top wall of the casing give the operator easy access to the interior of the casing and to heating element when it becomes necessary to replace it. The top wall openings also serve as installation ports for removable, elongated, vertically oriented, cylindrical inserts or container holders with a closed lower end and an open upper end. The inserts rest on the bottom or lower wall of the heating device casing and extend upwardly to and into loose fitting engagement with the upper wall of the casing.

The inserts position the containers of shampoo or other product in the casing of the heating device and are so constructed as to promote the transfer of heat from the heating element to the product. With the inserts removed from the casing of the heating device, both they and the interior of the casing can be easily cleaned. The inserts also facilitate the task of keeping the casing interior clean by capturing any product which might run or drip down the sides of the containers.

From the foregoing, it will be apparent to the reader that one primary and important object of the present invention resides in the provision of novel, improved devices for warming shampoos, conditioners, and other packaged products.

A related and also important objects of the invention resides in the provisions of such heating devices which have the attributes and advantages identified above.

Still other important features, advantages, and objects of the invention will be apparent to the reader from the foregoing and the appended claims and as the ensuing detailed description and discussion proceeds in conjunction with the accompanying drawings.

DETAILED DESCRIPTION OF THE INVENTION

Figure 1:
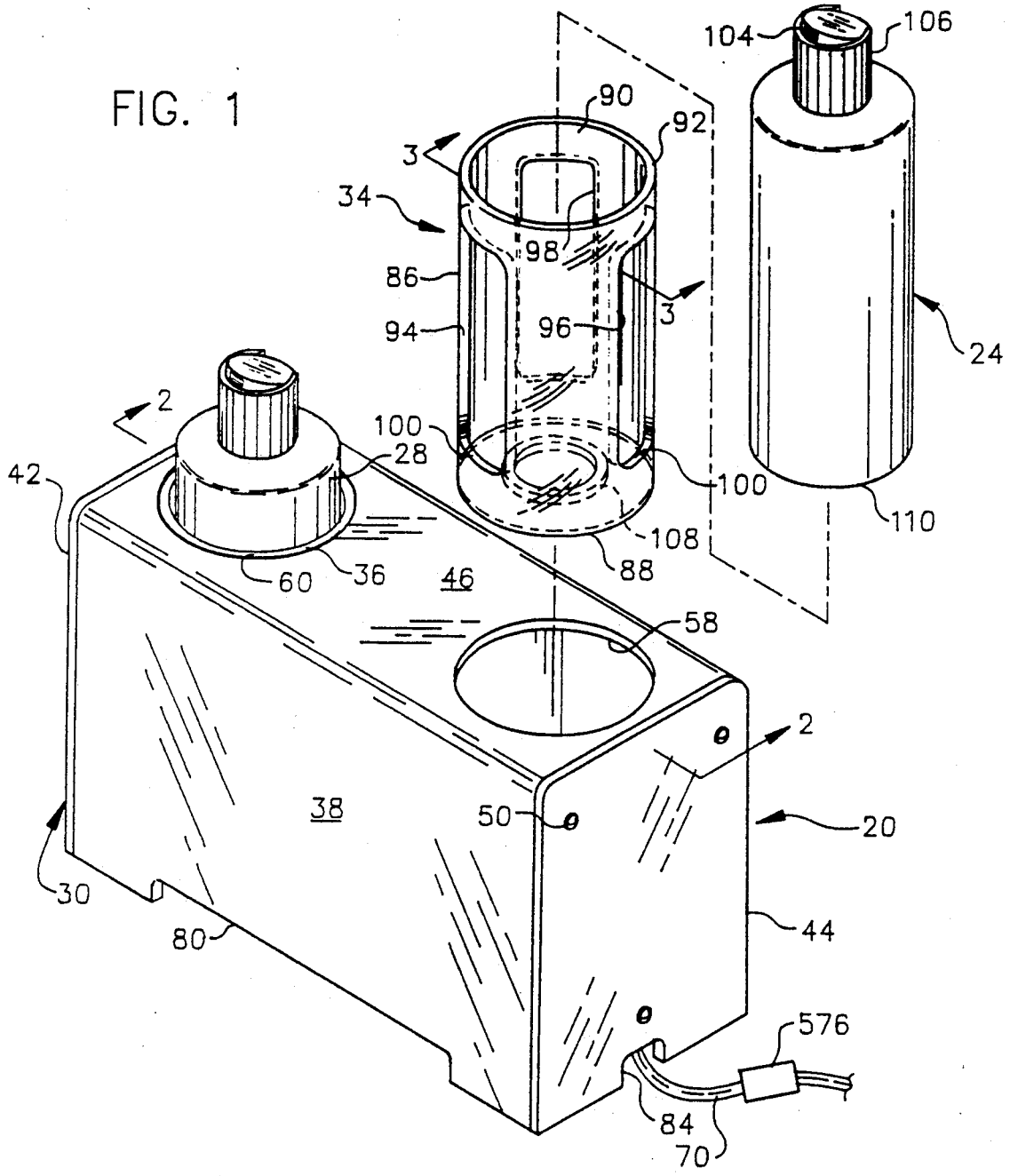
FIG. 1 is an exploded view of a heating device embodying the principles of the present invention and a bottle containing product which is to be warmed by the heating device.

Referring now to the drawings, FIG. 1 depicts a heating device 20 for warming the contents of a plastic bottle or container 24 and the contents of a second, similar container 28. Heating device 20 is constructed in accord with, and embodies the principles of the present invention. In a typical application, bottle 24 will contain a shampoo; and bottle 28 will contain a conditioner or rinse.

The major components of heating device 20 include a casing 30 which houses a radiant heater 32 (see FIG. 2) and two removable, container-receiving inserts 34 and 36 which also serve as heat sinks and even out the transfer of thermal energy to the products being heated. The casing 30 of heating device 20 has a parallelpipedal configuration defined by side walls 38 and 40, end walls 42 and 44, a top wall 46, and a bottom wall or base 48.

End wall 44 can be detached to give easy access to the interior of casing 30. It is secured in place as by the illustrated machine screws 50. These extend through the end wall and are threaded into two upper bosses 52 (only one of which is shown, see FIG. 2) and a lower boss 54. Bosses 52 extend inwardly from the side walls 38 and 40 of the casing adjacent op wall 46, and boss 54 extends upwardly from base 48 at a locus intermediate the casing side walls.

Internally threaded apertures 56 in the three bosses (only one of which is shown) accept screws 50 and retain them in place.

Openings 58 and 60 are formed through the top wall 46 of heating device casing 30. They are centered on the longitudinal, vertical centerplane of casing 30 and are located at equal distances from the end walls 42 and 44 of the casing. Openings or apertures 58 and 60 are configured to complement the cross sectional configuration of inserts 34 and 36. They are so dimensioned as to have a loose fit with the top wall 46 of the casing when the inserts are in place (see FIGS. 1 and 2).

Heating device casing 30 will typically be fabricated from a heat and impact resistent polymer such as Monsanto Plastic's 252, 452, or 752 Lustran ABS extrusion resins.

Figures 2, 3, 4, 5:
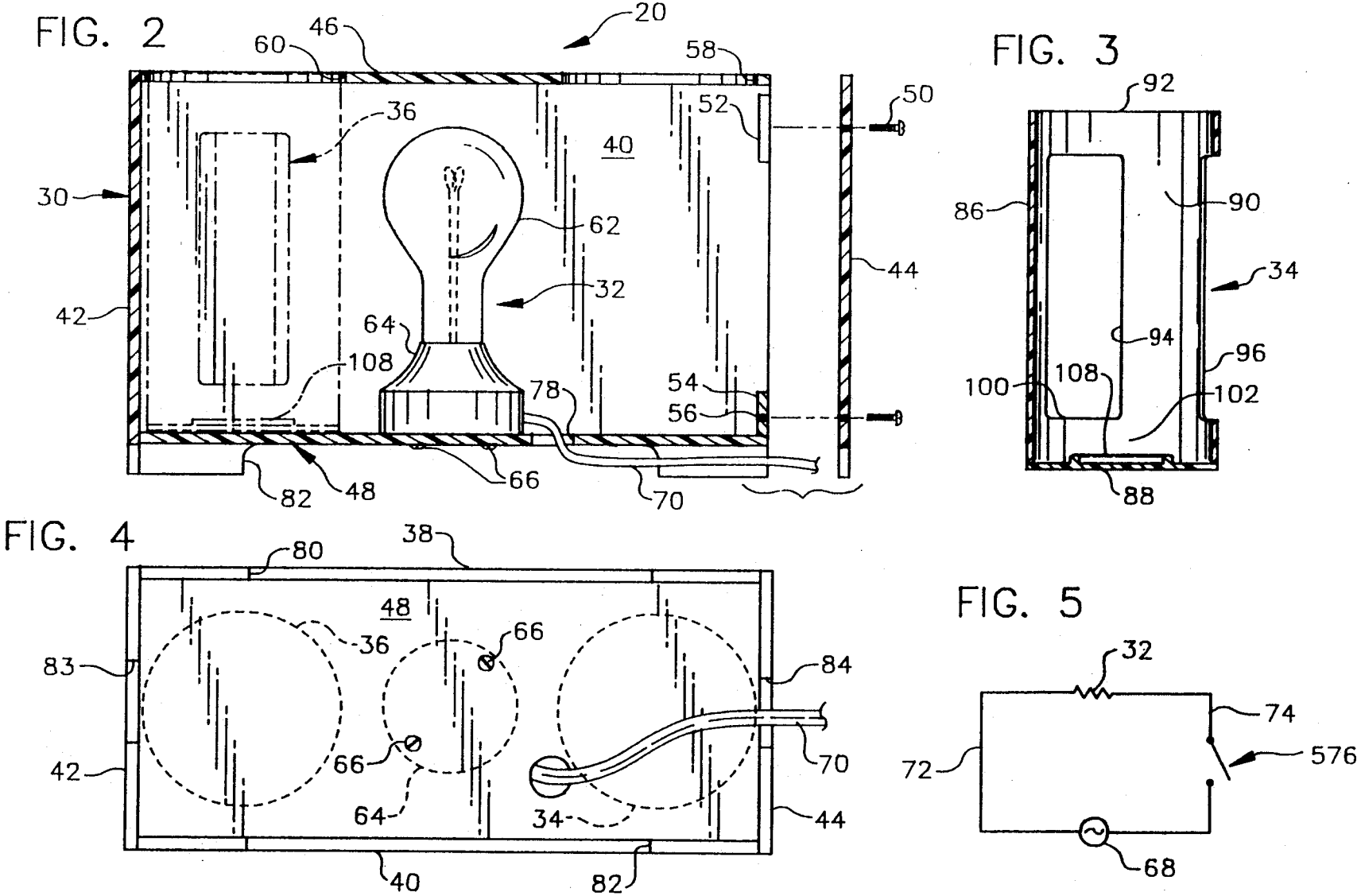
FIG. 2 is a longitudinal section through the heating device, show in this figure in a partially, disassembled configuration with the bottles and inserts removed.
FIG. 3 is a section through a removable insert which is a component of the heating device.
FIG. 4 is a bottom view of the heating device.
FIG. 5 is a schematic of an electric heater employed in the heating device.

Referring now specifically to FIG. 2, the radiant heater 32 of device 20 includes a conventional incandescent bulb 62 and an electrical socket 64. Socket 64 is centered between inserts 34 and 36 and also between casing side walls 38 and 40. It extends upwardly from base 48 to which it is attached as by the illustrated screws 66.

Socket 64 is connected to an external, typically 110V AC power source 68 (see FIG. 5) as by the illustrated line cord 70. The line cord has two leads or conductors 72 and 74. A line cord switch S76 allows an operator to turn the incandescent bulb 62 of radiant heater 32 on and off.

As is shown in FIGS. 1-3, line cord 70 is trained through an opening 78 in heating device casing base 48. Downwardly opening recesses 80 and 82 in casing side walls 38 and 40 and comparable recesses 83 and 84 in casing end walls 42 and 44 (see FIGS. 1 and 3) allow line cord 70 to be routed from beneath the heating device to a wall or floor socket, etc. (not shown) toward the front, the back, or either end of the casing. This is a decided convenience.

Bulb 62 is intended to warm the product in a container 24 or 26 to a temperature which is comfortable, not hot—typically a temperature in the 100°-107° F. range. A 25 watt bulb is typically the size best suited to maintain the product temperature in the preferred range.

Temperatures in the preferred range also have the advantage that they are not apt to cause unwanted changes in the chemical composition of the product. If the temperature to which a product can be safely heated is in doubt, this information should of course be solicited from the manufacturer or supplier.

The two container-receiving inserts 34 and 36 which position containers 24 and 26 in heating device casing 30 and in the wanted, equidistantly spaced relationship to radiant heater 32 are identical. Therefore, only insert 34 will be described in detail.

That insert, best shown in FIGS. 1 and 3, has a vertically extending side wall 86 and an integral bottom wall 88. These walls cooperate to define an open compartment 90 for container 24. While the cross sectional configurations of the insert and container are complementary, the internal diameter of the insert side wall 86 is larger than the external diameter of bottle 24. This allows the bottle to be easily installed in and removed from the insert.

Installed, inserts 34 and 36 are seated on the base 48 of heating device casing 30. They extend from that base up into the openings 58 and 60 through casing top wall 46 with the open, upper end of the insert (see, for example, that end of insert 30 identified by reference character 92 in FIG. 3) slightly below the exposed surface of the upper casing wall and out of an operator's way. At the same time, the loose fit between the insert and casing top wall 46 keeps the insert properly located in casing 30.

The inserts 34 and 36 and casing 30 are preferably so dimensioned in the vertical direction that the bottles 24 and 28 holding the products to be warmed will extend approximately the illustrated finger's width above the top wall of the casing. This promotes the heating of container contents 22 and 26 by placing the contents of the bottle almost entirely within casing 30, even if the bottle is full. At the same time, exposure of the container upper end makes it easy for the operator to install containers 24 and 28 in inserts 34 and 36 and to remove them from the inserts.

As is shown in FIGS. 1 and 3, inserts 34 and 36 are free of attachment to casing 30, and they can be removed from the casing with exceptional ease; i.e., by merely lifting them out of the casing through the associated top wall openings 58 and 60. Installation of the inserts in heating device casing 30 is equally simple. This is accomplished by lowering the inserts through openings 58 and 60 until they reach the base 48 of casing 30.

In a typical application of the present invention, the casing top wall openings 58 and 60 are 30 large enough in diameter for an operator's hand to fit through them.

This makes it easy to replace incandescent bulb 60 and to wipe clean the interior of casing 30, once inserts 34 and 36 have been removed in the manner just described. Alternative, and perhaps preferably, the bulb can be changed by removing casing end wall 46.

Inserts 34 and 36 are preferably fabricated of a relatively heat resistant polymer which is essentially transparent to the infrared radiation emitted by incandescent bulb 62. Among the many polymers which can be employed are the thermoplastic Rohm & Haas Plexiglas® poly(methyl methacrylates).

As is shown, vertical slots 94, 96, and 98 extend from toward the bottom wall 88 of insert 34 (and insert 36) toward the open, upper end of the insert so that air can circulate freely through the insert and between the insert and the container installed in it. This promotes the heating of the container's contents by natural convection of air heated by incandescent bulb 62 as well as by the radiant energy emitted from that infrared radiation source. Also, slots 94, 96, and 98 eliminate dead air spaces, ensuring that the product being warmed is uniformly heated.

As is shown in FIGS. 1 and 3, the lower ends 100 of slots 94, 96, and 98 are kept at a level well above the bottom wall 88 of the insert in which they are formed. This results in the side wall 86 and bottom wall 88 of the insert cooperating to form a cavity 102 in the lower end of bottle-receiving compartment 90..

Product leaked from a bottle 24 or 28 as through the valve 104 in its closure 106 and dripping down the container can collect in cavity 102. So can water reaching the bottle from an operator's hand—for example, from the hand of one giving a customer a shampoo in a beauty salon. This is an important practical feature of the present invention as it keeps the product, water, etc. from reaching and soiling the interior of heating device casing 30. Any foreign material which does collect in the bottom of the insert can be easily reached by removing end wall 46.

Also, by keeping water and other conductive fluids from running along the base 48 of casing 30, the inserts significantly reduce the exposure of persons using heating device 20 to electrical shock.

An integral, ringlike seat is formed on the top of each insert's bottom wall 88. This seat of insert 34 is identified by reference character 108 in FIGS. 1 and 3. The seat just described positions the bottom 110 of container 24 (or 28) above the bottom wall 88 of the associated insert 34 or 36. This keeps a product which may have escaped from a container or been left on the bottle by an operator's hand away from the bottom of that container. This avoids further soiling of the container by the product or liquid.

The integral seats 108 also allow heated air to circulate across the bottom 110 of container 24 and the bottom of container 28. That further contributes to the efficiency with which heating device 20 operates.

The operation of heating device 20 is believed to be apparent from the foregoing detailed description of that device. Nevertheless, for the sake of completeness, a summary of the modus operandi follows.

Unless done previously, the initial step is to install removable inserts 34 and 36 in heating device casing 30 in the manner discussed above. Next, the operator inserts the bottle or bottles containing the product to be heated in the insert(s) by lowering each container through a top wall opening 58 or 60 until it reaches the integral seat 108 on the insert bottom wall 88. Next, line cord switch S76 is manually closed, turning on heater 32. Thereafter, radiant energy emitted from the heater's incandescent bulb 62 and air warmed by the bulb and circulated into heat transfer relationship with the container by natural convection heat the container's contents. Once these are warm, which will typically take on the order of one hour, the operator removes the container from heating device 30 through the appropriate top wall opening 58 or 60 and utilizes the warmed product for the intended purpose. Of course, all or part of the bottles and their contents may be warmed before they are placed in the heating device 30. In that case, they are instantly ready for use.

The invention may be embodied in other forms without departing from the spirit or essential characteristics of the invention. The present embodiment is therefore to be considered in all respects as illustrative and not restrictive, the scope of the invention being indicated by the appended claims rather than by the foregoing description. All changes which come within the meaning and range of equivalency of the claims are therefore intended to be embraced therein.

What is claimed as the invention is:

1. The combination of a container bottle or other container and a heating device for warming the contents of said container, said device comprising:

a casing which has a horizontally orientable base and a top wall spaced upwardly from said base, there being an opening through said top wall;

a radiant heating means in said base adjacent said opening; and an open top, hollow, cylindrical, heat-transmissive, container-receiving insert in said casing, said insert being seated on said base and extending upwardly therefrom through the opening in the top wall into loose fitting relationship with said wall, said insert being free of attachment to said casing and being removable from said casing through said top wall opening;

said insert having an imperforate base and a side wall with an imperforate lower portion and thereby being capable of intercepting and trapping in the lower portion of the insert a product which may drip or run down the side of said container; and there being openings in an upper portion of the insert side wall through which air can circulate into convective heat transfer relationship with said container.

2. A combination as defined in claim 1 in which the base of said insert comprises a seat which so spaces the bottom of said container above the base of the insert as to (a) keep foreign material collected in said insert from soiling said container and (b) allow air to circulate across the bottom of said insert and thereby improve the efficiency with which heat is transferred to the contents of said container.

3. A combination as defined in claim 1 in which said insert is fabricated of a heat resistant material which is substantially transparent to infrared radiation.

4. A combination as defined in claim 1 in which the radiant heating means of said heating device comprises a socket mounted on and extending upwardly from the base of the heating device casing and an incandescent bulb threaded into said socket.

5. A combination as defined in claim 4 in which said heating device has a line cord extending from said socket through the base of the heating device casing to the exterior thereof, there being recesses in said casing so located that said line cord can be trained out from under said casing toward the front, back, or either end of the casing.

6. A combination as defined in claim 4 in which the heating device has a switch in said line cord for turning said radiant heating means on and off.

7. A combination as defined in claim 1 in which said heating device casing has one separate end wall which can be removed to give easy access to the interior of the casing and fastener means for securing said end wall in place.

8. A combination as defined in claim 1 in which the heating device casing has a top wall with multiple insert-receiving openings as aforesaid therein and an insert as aforesaid installed in said casing through each of said openings, said inserts being symmetrically located relative to said radiant heating means.

9. A combination heating device as defined in claim 1 in which there are two openings as aforesaid in the top wall of the heating device casing and an insert as aforesaid installed in said casing through each of said openings, said openings being located at opposite ends of the casing and the radiant heating means being midway between the openings.

* * * * *